US009677375B2

(12) United States Patent
Fitzhugh et al.

(10) Patent No.: US 9,677,375 B2
(45) Date of Patent: Jun. 13, 2017

(54) SHORTENED TUBING BAFFLE WITH LARGE SEALABLE BORE

(71) Applicant: Peak Completion Technologies, Inc., Midland, TX (US)

(72) Inventors: Bryan Fitzhugh, Midland, TX (US); William Sloane Muscroft, Midland, TX (US); Nathan Fitzhugh, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 0 days.

(21) Appl. No.: 14/844,192

(22) Filed: Sep. 3, 2015

(65) Prior Publication Data

US 2016/0061001 A1 Mar. 3, 2016

Related U.S. Application Data

(60) Provisional application No. 62/045,375, filed on Sep. 3, 2014, provisional application No. 62/069,794, filed on Oct. 28, 2014, provisional application No. 62/117,382, filed on Feb. 17, 2015.

(51) Int. Cl.
*E21B 33/129* (2006.01)
*E21B 23/06* (2006.01)

(52) U.S. Cl.
CPC ..... *E21B 33/1292* (2013.01); *E21B 23/06* (2013.01)

(58) Field of Classification Search
CPC ..... E21B 23/06; E21B 33/1292
See application file for complete search history.

(56) References Cited

U.S. PATENT DOCUMENTS 4,708,202 A * 11/1987 Sukup ..... E21B 33/1204 166/122
8,579,023 B1 11/2013 Nish et al.
9,057,260 B2 6/2015 Kelbie et al.
9,062,543 B1 6/2015 Snider et al.
2007/0227745 A1* 10/2007 Roberts ..... E21B 23/06 166/386
2011/0232899 A1* 9/2011 Porter ..... E21B 33/128 166/181
2013/0192853 A1* 8/2013 Themig ..... E21B 33/1216 166/387

(Continued)

OTHER PUBLICATIONS

International Search Report PCT/US2015/048278 Nov. 24, 2015.

(Continued)

*Primary Examiner* — James G Sayre

(57) ABSTRACT

Devices for controlling the flow of fluids past a location in a wellbore and methods for using such devices are disclosed. Embodiment devices are configured such that the through-bore is maximized because of the devices' thin cross sectional length. The devices disclosed may use balls, darts or other plugs to seal against a plug seat and prevent flow therethrough, external seals prevent flow therearound and gripping elements, such as slips, prevent movement of the device within the well. Relatively high pressure rating may be accomplished with such thin cross sections by keeping the length of mandrel wall exposed to such pressures short. Some embodiment devices may have a plug seat that is integral, at least in part, with a setting ring and/or have a setting ring that is of one piece with the mandrel.

24 Claims, 7 Drawing Sheets

(56) References Cited

U.S. PATENT DOCUMENTS

| | | | | |
|---|---|---|---|---|
| 2013/0240203 | A1 | 9/2013 | Frazier | |
| 2013/0299185 | A1* | 11/2013 | Xu | E21B 43/106 166/376 |
| 2013/0312952 | A1* | 11/2013 | Frazier | E21B 33/134 166/124 |
| 2014/0014339 | A1 | 1/2014 | O'Malley et al. | |
| 2014/0041857 | A1* | 2/2014 | Xu | E21B 33/128 166/118 |
| 2014/0209294 | A1* | 7/2014 | Sjostedt | E21B 33/128 166/135 |

OTHER PUBLICATIONS

Written Opinion PCT/US2015/048278.
Sales Sheet for the Baker Hughes Shadow Series Frac Plug, found at http://public.bakerhughes.com/shadow/pdf/38959.ShadowSeriesFracPlugs_OV.pdf.
Sales Sheet for the Alpha Oil Tools Big Bore Frac Plug found at http://www.alphaoiltools.com/AOT/AOT_- _Product_Information_files/Big_Bore_Frac.pdf.
Sales Sheet for the Schlumberger Copperhead Big Bore found at http://www.slb.com/~/media/Files/completions/product_sheets/mss/copperhead_big_bore_ps.pdf.
Sales Sheet for the Schlumberger Infinity Dissolvable plug and perf system found at http://www.slb.com/~/media/Files/completions/product_sheets/mss/infinity_ps.pdf.
Sales Sheet for the Tryton Maxfrac Plug, 2014 Tryton Tool Services Catalog, p. 22; found at http://www.trytontoolservices.com/files/16.Tryton%20November%202014%20Catalog.pdf.

* cited by examiner

SHORTENED TUBING BAFFLE WITH LARGE SEALABLE BORE

CROSS REFERENCE TO RELATED APPLICATIONS

This application claims the benefit of U.S. Provisional Patent Application Ser. No. 62/045,375 entitled "Shortened Bridge Plug with Large Sealable Bore" filed on Sep. 3, 2014; U.S. Provisional Patent Ser. No. 62/069,794 entitled "Shortened Bridge Plug with Large Sealable Bore" filed on Oct. 28, 2014, and U.S. Provisional Patent Application Ser. No. 62/117,382 entitled "Shortened Frac Baffle with Large Sealable Bore filed on Feb. 17, 2015; each of which is incorporated by reference herein.

STATEMENT REGARDING FEDERALLY SPONSORED RESEARCH OR DEVELOPMENT

Not applicable.

BACKGROUND

Field

Embodiments according to the present disclosure relate to flow control devices for use in oil and gas wells, and particularly to flow control devices used for isolating the portion of the well above the device from portions below the device. Such flow control devices may be used to isolate one region of the wellbore, and/or tubing installed in the wellbore, from other portions thereof and are commonly used in the completion of multiple formations accessed by a single well, multiple stage completions of a single formation, or other activities in which it is desirable to prevent fluid communication across a desired location within the well.

Description of Related Art

Current devices, such as frac plugs and bridge plugs, for preventing fluid communication across a location in a well are not totally satisfactory. Such devices may be limited to fluid isolation with relatively low pressure differentials, have an unsatisfactorily small (or non-existent) flow path therethrough when the device is an "open" state, require active intervention—such as mill-out or release—for their removal, utilize materials that take longer than is acceptable to mill out (e.g. have unacceptable machinability), have an excessive volume of material to be milled because of cross-sectional thickness and/or length, or combinations of these and other limitations.

Some such fluid barriers, such as bridge plugs, must be removed from the well, such as by drilling or milling out, before fluids can flow back from the formation to the wellhead. The bridge plugs function as fluid barriers in both directions, preventing fluid flow not only from the wellhead to the previously treated portion(s) of the well, but also from such treated portions to the wellhead. Drilling out bridge plugs can be a time consuming and expensive process involving workover rigs or coil tubing.

One alternative to bridge plugs and frac plugs is the baffle. These devices have an open throughbore that can be sealed with an appropriately sized ball, dart or other plug to prevent fluid flow from the wellhead to the formation. Higher pressure on the wellhead side of the baffle forces the plug into the baffle and the plug releases when pressure equalizes across the baffle or when pressure on the downwell side is greater than the upwell side. In this way, baffles may permit reservoir fluids to flow to the wellhead without the drilling out operation required for bridge plugs and frac plugs.

Present baffle designs have a throughbore that is unsatisfactorily narrow, which may lead to clogging—such as "sanding up" or other blockage—following completion of fracture treatments, such as during flowback. Further, the narrow throughbore limits the thru tubing tools that may pass through such baffles so that, even if such baffles may remain during initial production, they are likely to require drilling out when workover operations become necessary.

BRIEF SUMMARY

Embodiments of the present disclosure overcome the difficulties described above and/or strike an improved balance therebetween. Embodiment devices as described herein allow for significantly larger throughbores when the device is in the open state, making mill out an option rather than a necessity. Embodiments may be constructed primarily of materials more machinable than commonly used steels (e.g. such as P110 specification steels having a minimum 110 k psi yield strength), including steels of approximate yield strengths similar to certain ductile irons (e.g. L80 spec steels, having at least 80 k psi yield strength). Such materials may include ductile iron, composite materials, or others. Combined with an optimal minimized length and thin walls of the baffles herein, devices of the present disclosure provide improved milling time if the device must be removed.

Methods according to the present disclosure deploy a flow control device—such as a device having an upward facing plug seat—at a selected location in the tubing for use with plug and perf operations or any other application that could utilize a plug for isolation. A seal is created between the flow control device and the tubing, such as with a conventional packing element, and at least one slip flanking the element is set to hold the flow control device in place. The flow control device does not isolate the bore downwell of it until a sealing element (ball, dart, plug) is landed on/in the seat of the device. A treatment, such as a fracture treatment, can then be conducted through casing perforations upwell of such device. A subsequent tool may then be run in and set upwell of those perforations and the process repeated. Plugs are not required to pass through other seats before landing on the desired seat, thus permitting the throughbore of each seat, to have maximum diameter—e.g., the throughbore is not reduced in size because of the need to pass its corresponding plug through pre-installed seats upwell of the desired seat location.

Further, while some embodiments according to the present disclosure are configured for sealing by higher pressure on one side of a plug engaged with the baffle, the invention as claimed is not limited to such embodiments. Other configurations, such as configurations in which sealing does not require such pressure differential are envisioned. Such baffles have a seat configured to receive a selected plug or plugs (such as a ball, needle, disk, overshot, or other structure preventing, limiting, or controlling fluid flow when engaged with the seat). Such embodiments may be useful, for example, when closure of the baffle causes a pressure differential to build across the seat after the plug has been engaged.

Devices according to the disclosure herein may be configured to withstand greater pressure differentials in one direction than can be withstood in the other directions. For example, some embodiments may be configured to withstand, without moving in the well, a greater net force to the plug side of the tool, e.g. the side including the upper face or upper setting ring than the tool can withstand against the bottom side, the side including bottom section, of the tool. For example, during fracing operations, fluid pressure may be applied against the device and a plug sealing against the plug seat causing a pressure differential across the tool, thereby applying a net force against the plug side of tool. A pressure differential applying net force in the opposing direction may also be formed, such as during flowback or production operations, if a second ball or plug, or debris trapped downwell of the tool engages the bottom of the tool. However, the pressure differential created across a tool during flowback or production operations is typically less than a pressure differential from treatment operations.

Certain embodiments according to the disclosure herein are configured such that the throughbore is maximized because of the devices' thin cross section (e.g. a thin mandrel wall). Relatively high pressure rating may be accomplished with such thin cross sections by keeping the length of the mandrel wall exposed to such pressures short. In certain embodiments, the portion of mandrel wall exposed to pressure differentials may be eliminated entirely. Some embodiment devices may have a plug seat that is integral, at least in part, with a setting ring and/or have a setting ring that is of one piece with the mandrel.

DETAILED DESCRIPTION OF CERTAIN EMBODIMENTS

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the treating process, treating fluids and/or gasses move from the surface in the downwell direction to the portion of the tubing string within the formation.

Figure 1:
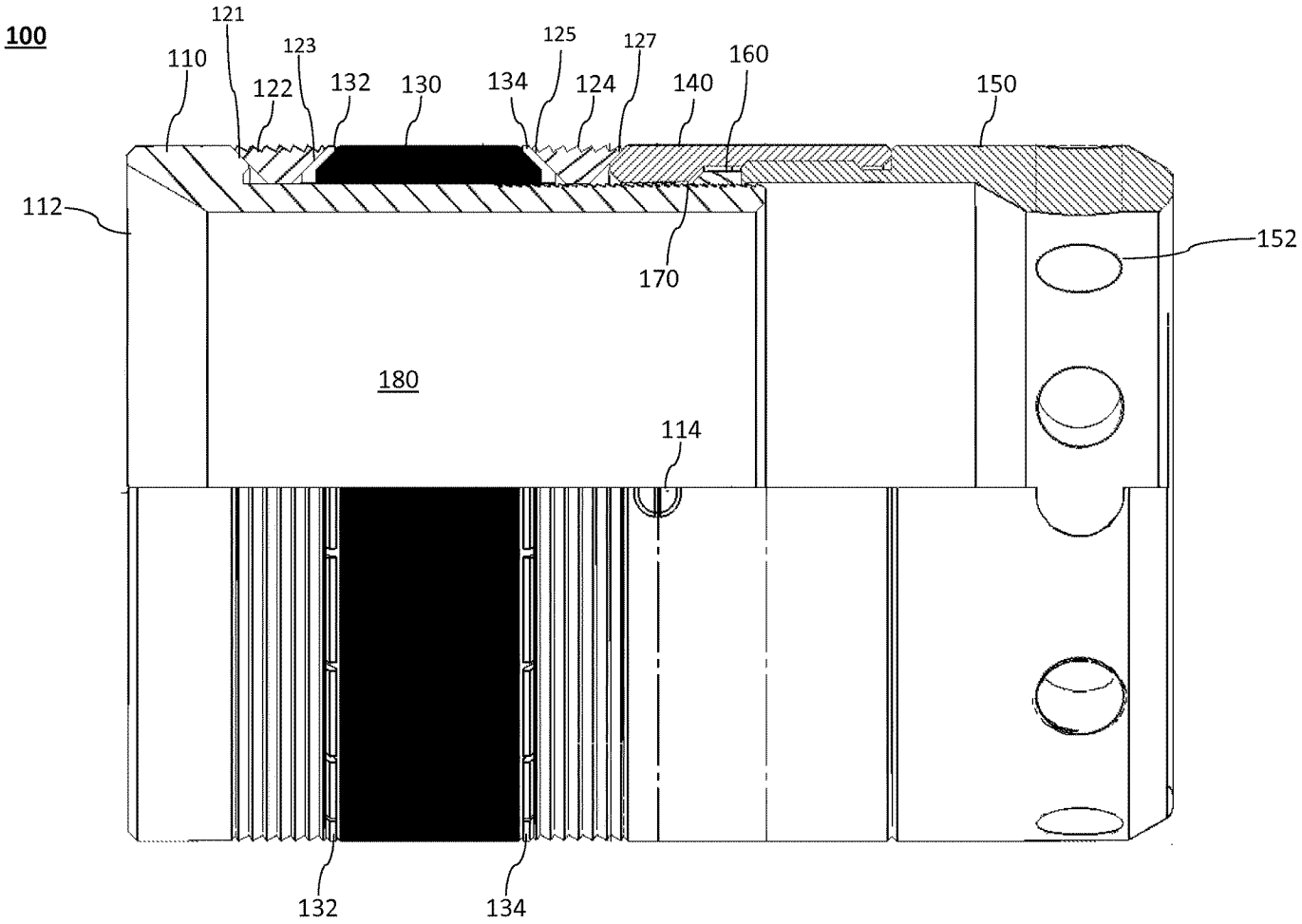
FIG. 1 is a sectional elevation of an embodiment baffle according the disclosure herein.

FIG. 1 shows an embodiment flow control device 100 according to the present disclosure. The embodiment of FIG. 1 comprises a mandrel 110, slips 122 and 124, rings 132 and 134, element 130, cone 140, bottom section 150 and ratchet ring 160. Mandrel 110 comprises at least one upper face 112, an interior surface 180 at least partially defining the throughbore of the tool, and mandrel teeth 170 positioned on at least part its exterior surface.

Slips 122, 124, rings 132, 134, and element 130 are arranged around an outer surface of mandrel 110 between mandrel shoulder 121 and cone shoulder 127. Slip 122 may be between mandrel shoulder 121 and ring 132. Slip 124 lies between cone shoulder 127 and ring 134. Rings 132, 134 are located on opposing ends of the element 130 between the element 130 and slip 122 or slip 124, respectively. Either or both of slips 122, 124 may, in conjunction with rings 132, 134, function as an expansion ring to limit or prevent extrusion of element 130 longitudinally between the outer surface of the device 100 and any tubing in which it is installed.

In the embodiment of FIG. 1, ratchet ring 160, positioned in a groove formed at least in part from cone 140, has a plurality of teeth configured to engage mandrel teeth 170 on the outer surface of mandrel 110. Ratchet ring may be positioned adjacent to bottom section 150 and one or more surfaces of bottom section 150 may form at least part of the groove or other structure holding ratchet ring 160 in the desired location.

In operation, embodiments of the present disclosure may be run in on wireline using a setting tool such as a conventional Baker style 10, Baker style 20, or Go-Shorty style hydraulic setting tool or other setting tool. Such setting tools are known in the art. The setting tool, which may also include a suitable or custom adapter for the specific embodiment, may be connected to the device via setting shear pins, or other releasable connection, connecting a setting mandrel to the bottom of the baffle, such setting shear pins connecting the setting tool to the embodiment device through one or more shear pin holes 152 in the bottom section 150. The setting tool, or adaptor, may also have a piston, such as a setting sleeve or setting nut, engaging the mandrel 110 at or near the upper face 112.

Once the setting tool is triggered, force is applied to the piston to move it towards the setting shear pins. Anti-preset shear pins 114 hold the mandrel 110 in place relative to the cone 140 until the setting tool is triggered. The anti-preset shear pins 114 are then broken by the force applied to the mandrel 110, e.g the setting force of the piston may be transferred to the mandrel 110 such that upper face 112 is forced towards the bottom section 150, reducing the distance between the mandrel shoulder 121 and the cone shoulder 127. As the mandrel 110 moves in response to actuation the mandrel teeth 170 sequentially engage the opposing teeth on ratchet ring 160, locking the mandrel 110 in the actuated state (shown in FIG. 2).

Figure 2:
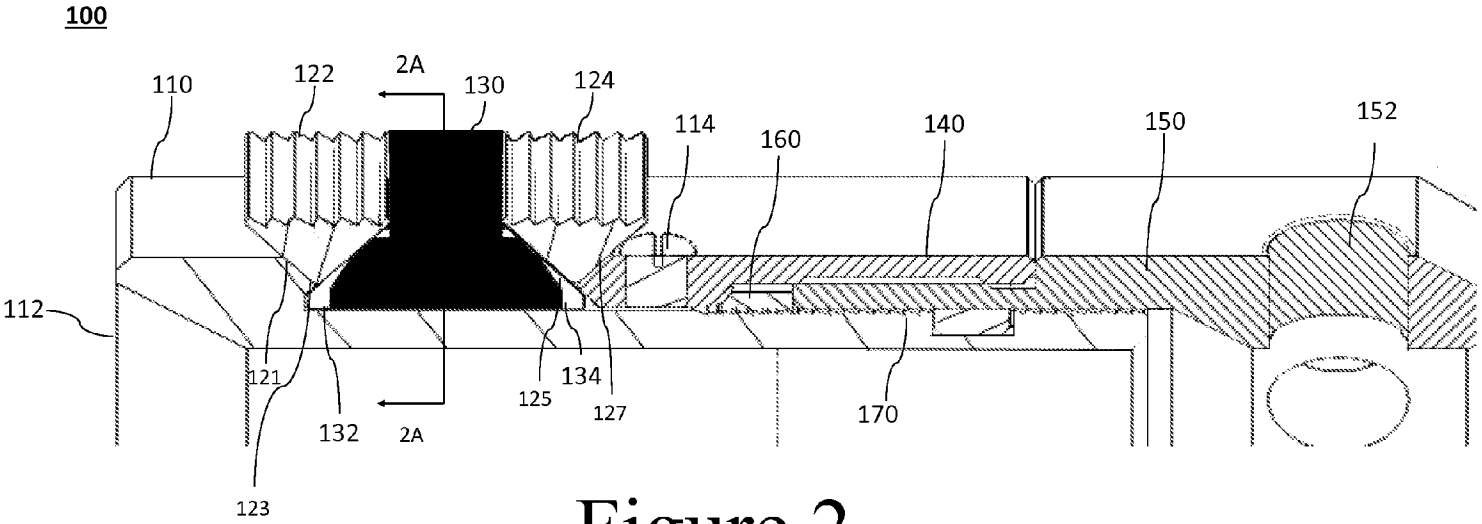
FIG. 2 is a sectional elevation of the embodiment baffle of FIG. 1 in the set position.
Figure 2A:
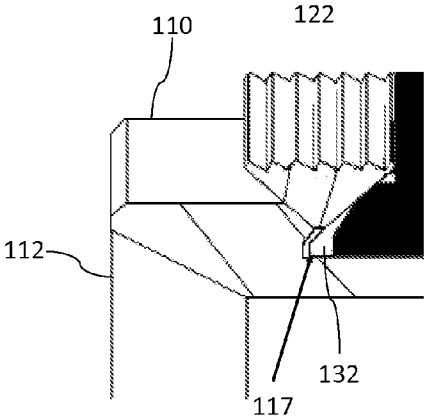
FIG. 2A is a partial sectional elevation of the baffle of FIG. 2 more fully disclosing the region adjacent the upper slip.

Movement of the mandrel shoulder 121 towards the cone shoulder 127 causes a reduction in the distance between the mandrel shoulder 121 and upper ring shoulder 123 as well as reducing the distance between lower ring shoulder 125 and cone shoulder 127. These reductions apply outward pressure to slips 122, 124 via the angular shoulders as can be seen in FIG. 2. Slips 122, 124 may be c-rings, other type of split ring, or other configurations known in the art, and therefore such outward pressure causes the slips to expand and the slip teeth to engage the tubing in which the device is to be installed. Further, the longitudinal travel of the mandrel 110 may be configured to have more travel than is necessary for expansion of the slips 122, 124. In this way, the element 130 can be compressed to provide a fluid pressure seal against the inner tubing surface against which the slips 122, 124 become engaged.

In certain embodiments, the mandrel shoulder 121 will be brought close to the ring shoulder 123. The angular profile of slip 122 may be arranged such that, when the slip 122 expands to engage the tubing, mandrel shoulder 121 and ring shoulder 123 are held about 2 inches apart or less, 1.5 inches or less or about 1 inch or less apart. In some embodiments, slip 122 holds mandrel shoulder 121 and ring shoulder 123 about one-half inch or less apart and in still further embodiments less than about one-quarter inch apart.

The distance between mandrel shoulder 121 and ring shoulder 123 may dictate the length of mandrel 110 exposed to the high pressure differential of the fracture or other treatment. When a plug engages upper face 112 to create a fluid seal, the throughbore defined by interior surface 180 of mandrel 110 is in fluid isolation from slip 122 and the outer surface of mandrel 110 adjacent to slip 122. Pressure in the tubing, such as from pumps at the surface, is applied to the outer surface of mandrel 110—from the upper face 112 to the upper edge of element 130—but not the inner surface of mandrel 110, creating a pressure differential across the upper portion of the mandrel, including at exposed length 117. The shorter the gap between mandrel shoulder 121 and ring 123, the shorter the length of mandrel 110 exposed to the pressure differential. In certain embodiments, shortening or eliminating the length of mandrel exposed to the pressure differential generated by engagement of a plug, such as by configuring the exposed length 117 to be relatively short when the device is installed, may allow the device 100 to withstand pressure differentials predicted to collapse the mandrel 110. Ring 132 may not form a fluid seal with mandrel 110, and therefore the exposed length 117 of the embodiment in FIG. 1 may include the region under ring 132 as well as the region between mandrel shoulder 121 and ring 132. Embodiments with a shortened exposed length 117 may have an exposed length that is from about 3.0 inches to about less than 0.25 inches, more preferably less than 2.0 inches. With exposed lengths 117 less than about 1 inch, the ability of the mandrel to withstand collapse pressures may increase substantially. In certain embodiments, the exposed length 117 is about 0.5 to about 0.25 inches or less when the tool is set, but larger exposed lengths may be necessary in embodiments having an enlarged slip 122.

In some embodiments, the seat for engaging a plug, such as upper face 112, may be adjacent the exposed length of mandrel 110, such as within about 0.5 to 1 inches. A solid plug, such as a ball may provide support to both the upper face 112 and the exposed length 117, including the region of exposed length 117 adjacent to the element stack, to prevent collapse at high pressure differentials across the mandrel wall.

The advantages of the present embodiments become readily apparent, allowing for a very short tool, as least as short as 8 inches prior to installation in some embodiments. Such shortened tool provides for more rapid mill out than longer baffles. Further, because of the large throughbore, drill out may not be necessary. Disintegrable plugs, such as dissolvable frac balls, may be used in conjunction with embodiments according to the disclosure herein, leaving the throughbore of the device free from obstruction after sufficient disintegration of the plugs because such plugs can then flow freely out of the well through the installed embodiment baffles. Further, disintegrable plugs may completely dissolve or suspend in wellbore fluids to be carried out of the well.

One or more shear pin holes 152 may be maintained without a shear pin, e.g. remain empty. Such empty shear pin holes may serve as a flowback bypass, such as when a plug from a downstream seat travels upwell to engage the bottom section 150. Such plug may be large enough to close the opening in the bottom section 150—e.g. block the throughbore by engaging bottom section 150—and an empty shear pin hole will allow fluid to enter the throughbore, thereby circumventing or bypassing such obstruction.

Embodiments with varying slips may be used. In addition to the opposing sips illustrated in FIG. 1, the present disclosure encompasses alternate embodiments such as configurations in which both slips oppose movement of the device in a single direction or in which the upper slip is absent and friction from the element assembly holds the device in place against upwell movement. Further, the c-ring slips may be substituted with many other slips known in the art, including barrel slips—e.g. slips 222 and 224 of FIG. 3.

Figure 3:
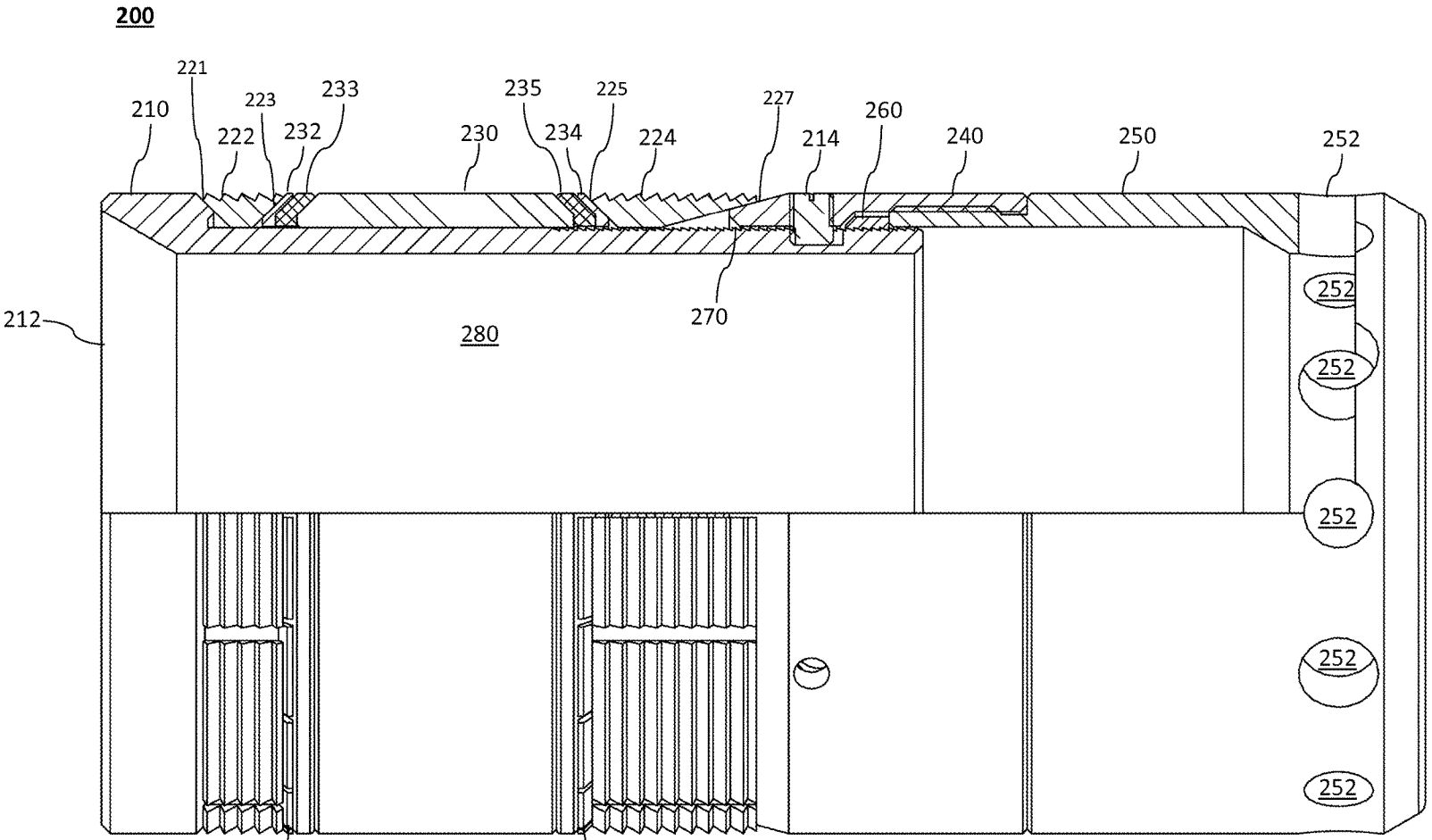
FIG. 3 is a sectional elevation of an alternate embodiment baffle.

FIG. 3 shows another embodiment downhole tool 200 according to the present disclosure. The embodiment of FIG. 3 comprises a mandrel 210, slips 222 and 224, rings 232 and 234, element 230, cone 240, bottom section 250 and ratchet ring 260. Mandrel 210 comprises at least one upper face 212, an interior surface 280, and mandrel teeth 270 positioned on at least part its exterior surface.

Slips 222, 224, rings 232, 234, and element 230 are arranged around an outer surface of mandrel 210 between mandrel shoulder 221 and cone shoulder 227. Slip 222 may be between mandrel shoulder 221 and ring 232. Slip 224 lies between cone shoulder 227 and ring 234. Rings 232, 234 are located on opposing ends of the element 230 between the element 230 and slip 222 or slip 224, respectively. Ratchet ring 260, positioned in a groove formed at least in part from cone 240, has a plurality of teeth configured to engage mandrel teeth 270 on the outer surface of mandrel 210. Ratchet ring 260 may be positioned adjacent to bottom section 250 and one or more surfaces of bottom section 250 may form at least part of the groove or other structure holding ratchet ring 260 in the desired location.

It will be appreciated that shoulder 227 of cone 240 may be flatter than shoulder 127 of cone 140 as seen in FIG. 1. The angles of each of the shoulders may be adjusted, or coordinated with different element stacks, in order to optimize the strength with which the slips 224 and 222 hold the tubing in which the device is installed and/or the force applied to the element or element stack to create a fluid seal. Lower slip 224 may be arranged to engage a casing, liner, or other tubular in order to prevent movement of the tool in response to net force against plug side of the tool.

In addition, the element stack may come in different configurations. The element stack in FIG. 1 has a ring 132, 134, which may be a metal ring, around either side of the element. The embodiment of FIG. 3 has a metal ring 232, 234 on either side of the element 230. However, a Teflon® ring 233, 235 can be interposed between the metal ring 232, 234, respectively, and element 230. Other element stacks that are or become known in the art are also within the scope of the present disclosure.

Figure 4:
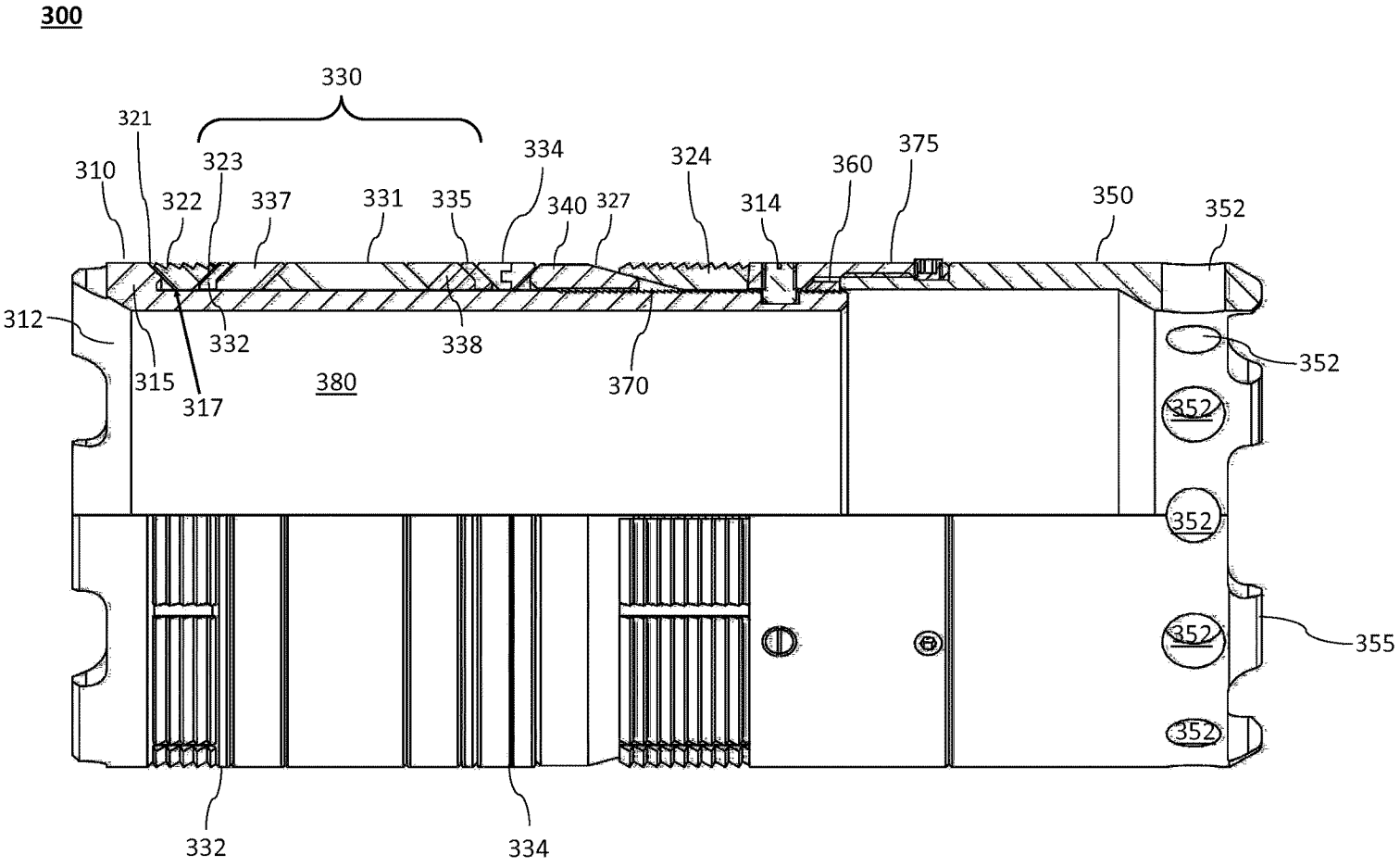
FIG. 4 is a sectional elevation of a baffle having an alternative embodiment baffle.

FIG. 4 shows another embodiment device 300 according to the present disclosure comprising a mandrel 310, slips 322 and 324, rings 332 and 335, backup ring 334, element 330, cone 340, bottom section 350, and ratchet housing 375 which includes ratchet ring 360. Ratchet housing 375 may be connected to bottom section 350 and slidingly engaged with mandrel 310 such that ratchet housing 375 and bottom section 350 telescope over mandrel 310 (or mandrel 310 telescopes into the ratchet housing 375 and bottom section 350) when the flow control device is set in the tubing. Ratchet housing 375 engages slip 324 such that the ratchet housing 375 may apply force to slip 324, pushing slip onto cone 340 at the angular surface 327 of cone 340. This forces slip 324 radially outward and applies longitudinal force to cone 324, which in turn applies force to element 330 for creating a fluid seal against the tubing.

Mandrel 310 comprises at least one upper face 312, an interior surface 380 at least partially defining the through-bore of the tool, and mandrel teeth 370 positioned on at least part its exterior surface. Mandrel 310 may have an enlarged end 315 which may be of a single piece with the remainder of the mandrel and function as a setting ring. It will be appreciated that the compressed element 330 exerts force back towards the upper and lower setting rings—enlarged end 315 and lock ring housing 375 in FIG. 4—in an attempt to relax from its compressed state. The slips, including slip 322 when present, may redirect such force, at least in part, to the tubing in which the device is set. Slip 322 may thereby reduce or substantially reduce the tensile load placed on the mandrel 310 via the setting ring, further facilitating the thinness of the device wall, including the thin exposed length of the mandrel.

Slips 322, 324, rings 332, 335, backup ring 334 and element stack 330 are arranged around an outer surface of mandrel 310 between mandrel shoulder 321 and ratchet housing 375. Slip 322 may be between mandrel shoulder 321 and ring shoulder 323. Slip 324 lies between cone shoulder 327 and ratchet housing 375. Rings 332, 335 are located on opposing ends of the element stack 330 between the element stack 330 and slip 322 or backup ring 334, respectively. Rings 332, 335 may be of any number of materials depending on the desired application. In some embodiments rings 332, 335 may be of ductile iron or other material. Back up rings such as back up ring 334 are also known in the art. Certain embodiment back up rings may be opposing c-rings made of ductile iron, elastomeric materials such as poly-ether-ether-ketone (PEEK) or other suitable elastomers, or an array of other materials.

Ratchet ring 360, which may be positioned in a groove formed at least in part from ratchet housing 375, has a plurality of teeth configured to engage mandrel teeth 370 on the outer surface of mandrel 310. Anti-preset shear pin 314 engages both ratchet housing 375 and mandrel 310, preventing telescoping down of the tool, and therefore setting of slips 322, 324 and element 330 until the shear pin is broken. It will be appreciated that shoulder 327 of cone 340 may have a different angle than shoulder 127 of cone 140 as seen in FIG. 1. The angles of each of the shoulders may be adjusted, or coordinated with different element stacks, in order to optimize the strength with which the slips, 124, 324 in FIG. 1 and FIG. 3, respectively, grab the tubing in which the downhole tool is installed. Ratchet ring 360 may be positioned adjacent to bottom section 350 and one or more surfaces of bottom section 350 may form at least part of the groove or other structure positioning ratchet ring 360.

The presence of the upper slip in certain embodiments may facilitate through tubing workover operations. After such operations are completed, the through tubing and any bottom hole assembly, or "BHA", attached thereto must be removed. Such tubing or BHA may tag, hang up, or otherwise engage the lower end of the device, such as device 300. The presence of upper slip 322 may prevent movement of the device 300 in the tubing in response to such engagement.

In the embodiment of FIG. 4, a lower slip 324 may be arranged to engage a casing, liner, or other tubular in order to prevent movement of the tool in response to net force against plug side of the tool, e.g. the side of the tool where seat 312 is located. Such slip will be configured to engage the casing or other tubing in which the device is set and to hold the device, including a plug engaged on plug seat 312, against the anticipated treatment pressures.

Element stacks for tools according to the present disclosure may also come in different configurations. The element stack in FIG. 1 has a ring 132, 134, which may be a metal ring, around either side of the element. The embodiment of FIG. 3 has a metal ring 232, 234 on either side of the element 230. However, a Teflon® ring 233, 235 can be interposed between metal rings 232, 234 and element 230. The element stack of FIG. 4 may comprise an element 331 of 80 durometer rubber flanked by rings 337, 338 of 90 durometer rubber between element 331 and rings 332, 335, respectively. Other element stacks that are or become known in the art are also within the scope of the present disclosure and such element may be chosen based on a particular application of the fluid control device.

Devices according the present disclosure may be configured for installation into casing or other tubing of various sizes. In the run-in position, e.g. before the tool is set, the outer diameter of the tool must be smaller than the smallest diameter of the tubing through which the tool is run and into which it is installed. Further, the element and the slips must have sufficient capability to expand within the tubing to form a sufficient fluid seal and grip the tubing wall, respectively, to withstand the anticipated differential pressure expected to be created across the tool. Still further, the mandrel must be configured to withstand the collapse forces from pressure differentials anticipated for the tool, certain embodiment tools being designed to limit and/or avoid pressure differentials applying a burst force.

Figure 6:
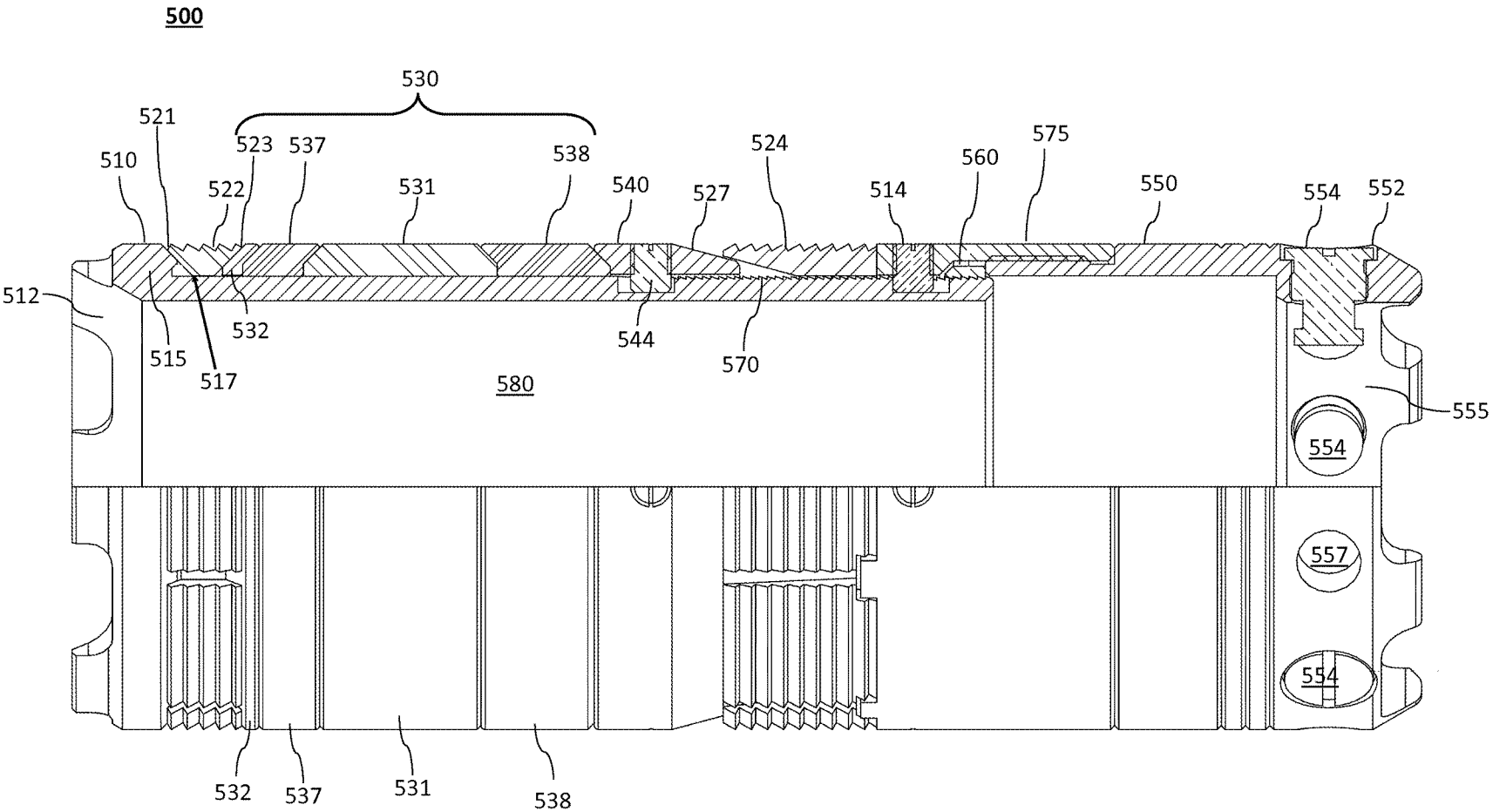
FIG. 6 is a sectional elevation of an alternative embodiment baffle.

Embodiment tools of the present disclosure have been shown to have pressure ratings of at least 4000 psi, such as the embodiment tool in FIG. 1, and 10,000 psi for the embodiment tools in FIGS. 4 and 6 utilizing a barrel slip as the lower slip.

In some embodiment tools, the pressure rating of 10,000 psi may be achieved with a mandrel made of ductile iron and having very thin walls at the exposed length. For example, ductile iron with a yield strength of about 70 k, and in certain tests 74.5 k, psi was used in a mandrel, such as mandrel 310 with mandrel wall thickness of about 0.188 inches at the exposed length through the portions of the mandrel engaging the element stack 330, cone 340, ratchet housing 375. In actual fracturing procedures in a wellbore, embodiment tools according to FIG. 4, including an exposed length 317 wall thickness of 0.188 inches, withstood fracturing pressure differentials averaging over 8100 psi for more than 2.5 hours. In certain embodiments, the element, slips, cone, and ratchet ring have a wall thickness of about 0.25 inches.

It will be appreciated that the inner diameter of a flow control device of the present disclosure is determined by three factors: the drift diameter of the tubing in which the device is to be installed, the ratio chosen for the outer diameter of the device relative to the drift diameter, and the wall thickness of the device itself. In some embodiments the outer diameter of the device may range from about 95% of the drift diameter to about 98% of the drift diameter for the tubing size and/or weight with the smallest inner diameter and, more preferably from about 96.5% of the drift diameter to 97.5% of the drift diameter, including devices having ratios of about 97% of the drift diameter. Thus, for devices according to the present disclosure with the largest through-bore for a given casing size, the inner diameter may be about 98% of the drift diameter minus 0.875 inches—the 0.875 inches corresponding to two times the thickness of one wall. Thinner mandrel walls, and therefore thinner tool walls, may be achievable using higher yield materials, but such thinner walls may increase drill out time without providing an appreciably larger throughbore. For embodiment devices configured to span multiple casing weights, the diameter of the throughbore may range from about 88% of drift minus 0.875 inches up to 98% of drift minus 0.875 inches for a device designed to span three casing weights, depending on which of the three casing weights into which the device is installed. For devices designed to span two casing weights, the inner diameter may range from about 92% of drift minus 0.875 inches to about 98% of drift minus 0.875 inches in some embodiments or from about 94% of drift minus 0.875 inches to about 98% of drift minus 0.875 inches.

In some embodiments, it may be desirable to increase the thickness of the walls in order to increase outward travel of the slips, e.g. slips 322, 324 of FIG. 4. The radially outward travel of the slips may be limited, at least in part, by the angular surface 327 of cone 340 for lower slip 324 or by the angular surface 321 of the setting ring for the upper slip 322. Making the angular surfaces 321, 327 deeper, such as by thickening the cone and/or making the slips radially thicker can increase the ability of the slips 322, 324 to travel outward and engage the tubing. For devices in 5.5" casing, for example, it may be desirable to increase the outward stroke of the slips by about 0.25 inches diametrically to span casing sizes from 17# to 23#. This may be done, for example, by increasing the thickness of the cone by 0.25 inches or by increasing the thickness of the cone and the slips by a combined 0.25 inches, e.g. by thickening each 0.125 inches diametrically. Such an arrangement may lead to tool wall thickness for one wall of about 0.5 inches to about 0.67 inches. For a device spanning two casing weights, the outward travel increases by about 0.115 inches. Thus, the tool wall thickness may increase by about 0.03 to 0.06 inches (e.g. up to 0.47 inches or 0.50 inches) when compared to a device configured for only one casing weight in 5.5" outer diameter casing. In 4.5" inch casing, a device spanning three casing sizes may, where desired, have a wall thickness of about 0.46 inches to about 0.49 inches.

The thin wall enabled by devices according to the present disclosure allows the larger throughbore sizes of these baffles. Prior art baffles have wall thicknesses much larger, at least about 0.55 inches (radially, 1.10 inches diametrically) using steel in the mandrel and about 0.78 inches (radially, 1.56 inches diametrically) with an iron mandrel.

Figure 5:
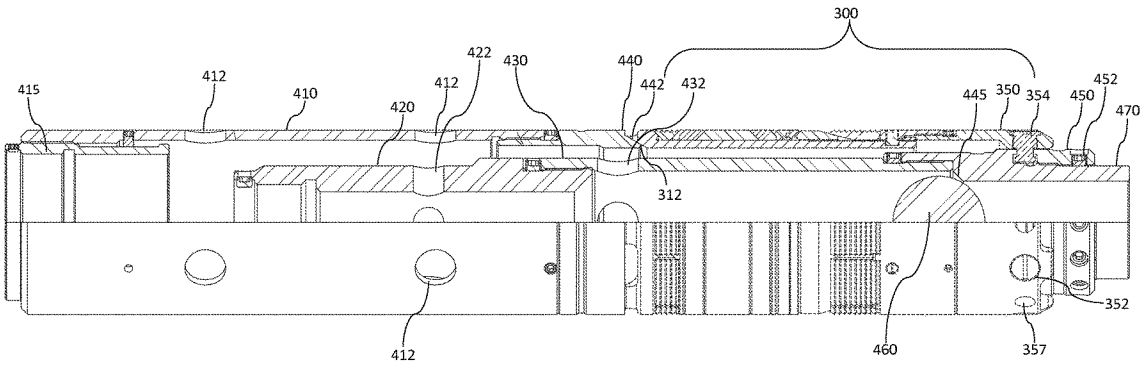
FIG. 5 is a sectional elevation of a run assembly showing the baffle of FIG. 4 and a Wireline Adaptor Kit.

FIG. 5 illustrates an embodiment device 300, such as from FIG. 4, assembled on a wireline adapter kit (WLAK) as it might be run into a well. Upper face 312, bottom section 350, and shear pin holes 352 of device 300 are shown in FIG. 5 and are arranged generally as described in reference to FIG. 4.

The WLAK comprises an outer adapter crossover 415 connected to setting sleeve 410 which is in turn connected to setting nut 440. Setting nut has angular surface 442 which complements upper face 312. WLAK further comprises an inner adapter crossover 420 connected to one end of WLAK mandrel extension 430 and WLAK mandrel 470 may be connected to the opposing end of WLAK extension mandrel 430.

Setting shear pins 354 connect bottom section 350 to WLAK mandrel 470. In some embodiments, WLAK mandrel 470 may include shear trap 450. Such shear trap may allow for connection of shear pin 354 to WLAK mandrel around a lower shoulder of shear pin 354. The lower shoulder of the shear pin has a greater diameter than the hole in WLAK mandrel 470 and shear trap 450 through which shear pin 354 passes. Thus, when setting shear pin 354 is broken, the threaded portion of the shear pin remains in shear pin holes 352 and the sheared off portion of shear pin 354 is contained by WLAK mandrel 470 in the shear trap 450. Bypass holes 357, which may be shear pin holes 352 without shear pins placed therein, are shown in FIG. 5 to illustrate their location relative to other components of the baffle 300.

WLAK mandrel extension 430 may contain a check valve, such as a ball 460 and seat 445 check valve. Embodiment assemblies having a check valve, such as is disclosed in FIG. 5, may be particularly useful in wellbores with long lateral or horizontal sections. During run-in prior to installation, the devices may "fall" through the vertical section of the well and then may be pumped through a lateral section. Devices with larger throughbores "fall" more readily because of the decrease in fluid volume displacement caused by the device. Ports 412, 422, 432 allow fluid communication between the various annuli of the assembly, facilitating the flow of fluids therebetween and further facilitating fall of the assembly in a vertical section.

Though a larger throughbore may be desirable in a vertical section of a well, the smaller volume displacement of large throughbore devices may undesirably increase the pumping time through the lateral section of a horizontal well. The check valve of the assembly in FIG. 5 allows for the throughbore to be open when the assembly is falling in the vertical section because fluid pressure on the WLAK mandrel 470 side of the assembly is greater than on the outer adapter crossover 415 side, pushing the ball 460 off seat 445 and allowing fluid to flow through the throughbore. When the assembly reaches the lateral section of the wellbore, fluid pressure is applied to the well, such as by pumps at the surface, causing pressure to be higher at the outer adapter crossover 415 side of the device than at the WLAK mandrel 470 side, forcing the ball 460 into seat 445 and preventing fluid flow through the throughbore. The check valve enables the throughbore to go from an open state to a closed state, increasing the fluid displacement of the assembly and allowing a given pressure differential to move the assembly at a higher rate of speed. The higher speed decreases the run-in time required for the device to reach its desired location.

Once the desired position is reached, the setting tool is actuated. The setting tool may force the outer adapter crossover 415 downward (e.g. toward shear pin 354) while the inner adapter crossover 420 is held in place. This forces setting nut 440 downward as well, applying force to mandrel (310 in FIG. 4) which shears anti-preset shear pin 314 and moves the mandrel 310 into bottom section 350, expanding the slips 322, 324 and compressing the element 330 as discussed above, thereby setting the device 300. When the force required to further telescope the bottom section 350 over mandrel 310 exceeds the strength of sheer pins, 354, the sheer pins break and release the WLAK from device 300. The setting tool and WLAK can then be removed, where desired, and operations may proceed.

Another embodiment flow control device is shown in FIG. 6, comprising a mandrel 510, slips 522 and 524, ring 532, element 530, cone 540, bottom section 550, and ratchet housing 575 which includes ratchet ring 560. Ratchet housing 575 may be connected to bottom section 550 and slidingly engaged with mandrel 510 such that ratchet housing 575 and bottom section 550 telescope over mandrel 510 (or mandrel 510 telescopes into the ratchet housing 575 and bottom section 550) when the flow control device is set in the tubing. Ratchet housing 575 engages slip 524 such that the ratchet housing 575 may apply force to slip 524, pushing slip onto cone 540 at the angular surface 527 of cone 540. This forces slip 524 radially outward and applies longitudinal force to cone 540, which in turn applies force to element 530 for creating a fluid seal against the tubing.

Mandrel 510 comprises at least one upper face 512, an interior surface 580 at least partially defining the throughbore of the tool, and mandrel teeth 570 positioned on at least part of its exterior surface. Mandrel 510 may have an enlarged end 515 which may function as a setting ring.

Slips 522, 524 (which may be hardened), ring 532, and element stack 530 are arranged around an outer surface of mandrel 510 between mandrel shoulder 521 and ratchet housing 575. Slip 522 may be between mandrel shoulder 521 and ring 532. Slip 324 lies between cone shoulder 527 and ratchet housing 575. Ring 532 may be of any number of materials known in the art depending on the desired application. In some embodiments, rings 532 may be of a ductile material such as ductile iron or other material.

Ratchet ring 560, positioned in a groove formed at least in part from ratchet housing 575, has a plurality of teeth configured to engage mandrel teeth 570 on the outer surface of mandrel 510. Anti-preset shear pin 514 engages both ratchet housing 575 and mandrel 510, preventing telescoping down of the tool, and therefore setting of slips 522, 524 and element 530 until the shear pin is broken. It will be appreciated that shoulder 527 of cone 540 may be optimized to different angles depending on the needed pressure rating of the flow control device. For example, the angles of the shoulder may be adjusted, or coordinated with different element stacks, in order to optimize the strength with which the slips 524 grab the tubing in which the downhole tool is installed. Ratchet ring 560 may be positioned adjacent to bottom section 550 and one or more surfaces of bottom section 550 may form at least part of the groove or other structure holding ratchet ring 560 in the desired location.

Lower slip 524 may be arranged to engage a casing, liner, or other tubular in order to prevent movement of the tool in response to net force against plug side of the tool, e.g. the side of the tool where upper face 512 is located. In order to withstand the large net force that may occur during fracing operation, lower slip 524 may have an optimized exterior surface, such as toothed surface between 1 and 1.25 inches in width in some embodiments, to provide greater holding force than the similarly configured, but narrower upper slip 522 which may be placed on the upwell side of the embodiment of FIG. 6.

FIG. 6 illustrates an embodiment element stack 530 in which the lower element stack ring 538 is widened. Such embodiment may be constructed without a ring such as ring 335 or a backup ring such as back up ring 334, both illustrated in FIG. 4. The lower element stack ring 538 may be of 95 durometer rubber or other rubber of suitable mechanical characteristics. Further, cone 540 may have a cone lock, such as shear pin 544, to prevent movement of the cone prior to actuation of the setting tool such as is described in relation to FIG. 5, and connected to the embodiment of FIG. 6 by shear pins 554 in shear pin holes 552. Bypass holes, 557, which may be shear pin holes 552 without shear pins therein, may provide a flow bypass if a ball, plug, or debris engage the throughbore adjacent the bottom section 650 crenels.

Lower section 550 may have an inner surface 555, which may be adjacent to shear pin holes 552, with a diameter slightly smaller (e.g. 0.030 inches) than the inner diameter of the mandrel 510. Such inner surface 555 with smaller diameter will prevent plugs, such as frac balls, located below the flow control device from lodging within the mandrel and blocking flow therethrough. Any such plug which can pass inner surface 555 can also pass through the larger throughbore of the mandrel.

Upper face 512 and lower section 550 may be crenelated. The crenels of upper face 512 may be coordinated with the crenels of the lower section 550 for a tool to be installed above the flow control device. Such crenels operate as a clutch, similar to a muleshoe on certain prior art frac plugs, preventing a device or component from spinning, such as if engaged by a mill. Such crenels aid with mill out when multiple tools are installed, as is known in the art.

Figure 7:
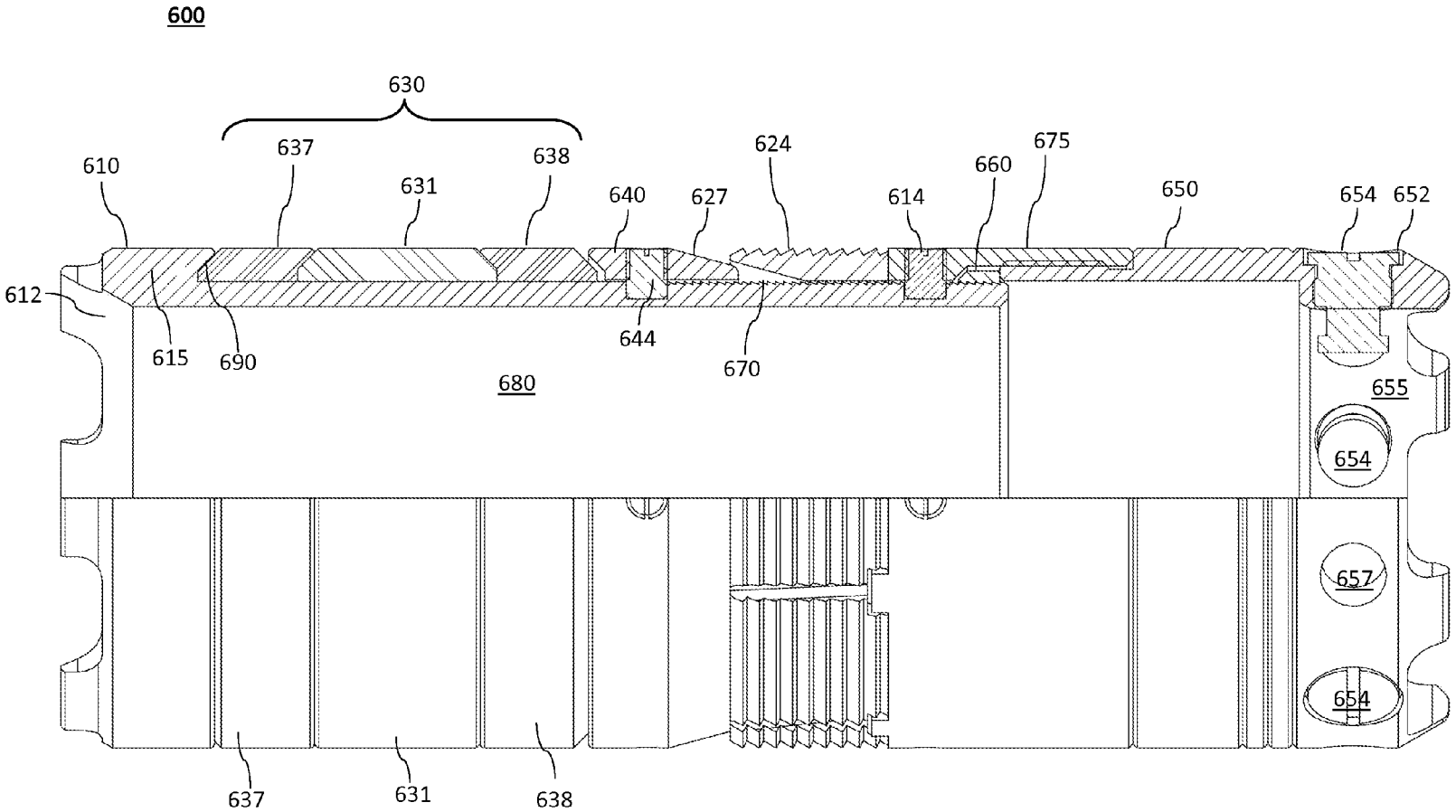
FIG. 7 is a sectional elevation of an alternative embodiment baffle.

Another embodiment flow control device 600 is shown in FIG. 7, comprising a mandrel 610, slips 624, element 630, cone 640, bottom section 650, and ratchet housing 675 which includes ratchet ring 660. Ratchet housing 675 may be connected to bottom section 650 and slidingly engaged with mandrel 610 such that ratchet housing 675 and bottom section 650 telescope over mandrel 610 (or mandrel 610 telescopes into the ratchet housing 675 and bottom section 650) when the flow control device is set in the tubing. Ratchet housing 675 engages slip 624 such that the ratchet housing 675 may apply force to slip 624, pushing slip onto cone 640 at the angular surface 627 of cone 640. This forces slip 624 radially outward and applies longitudinal force to cone 640, which in turn applies force to element 630 for creating a fluid seal against the tubing.

Mandrel 610 may comprise at least one upper face 612, an interior surface 680 at least partially defining the throughbore of the tool, and mandrel teeth 670 positioned on at least part of its exterior surface. Mandrel 610 may be a portion of a single piece having an enlarged end 615 which may function as a setting ring. Such single piece thereby may comprises mandrel 610 and a setting ring, and may include a plug seat, such as on upper face 612.

Slips 624 (which may be hardened) and element stack 630 are arranged around an outer surface of mandrel 610 between ring shoulder 690 and ratchet housing 675. Slip 624 lies between cone shoulder 627 and ratchet housing 675. Ring shoulder 690 may function, among other things, as a thimble to help prevent swabbing of elastomeric components, such as portions of element 630, off of the mandrel and/or to increase the sealing surface of element 630 and mandrel 610. It will be appreciated that engagement of ring shoulder 690 with upper element stack ring 637 creates a fluid seal therebetween. Such arrangement prevents creation of a pressure differential across the mandrel wall (e.g. the exposed length is not only less than 0.25 inches longitudinally, it is eliminated) because upper element stack 637 seals against ring shoulder 690 and the outer wall of mandrel 610.

Ratchet ring 660, which may be positioned in a groove formed at least in part from ratchet housing 675, has a plurality of teeth configured to engage mandrel teeth 670 on the outer surface of mandrel 610. Anti-preset shear pin 614 engages both ratchet housing 675 and mandrel 610, preventing telescoping down of the tool, and therefore setting of slips 624 and element 630 until the shear pin is broken. Ratchet ring 660 may be positioned adjacent to bottom section 650 and one or more surfaces of bottom section 650 may form at least part of the groove or other structure holding ratchet ring 660 in the desired position.

During treatment operations, fluid pressure may be applied against the downhole tool 600 and a plug sealing against the upper face 612 (plug not shown), creating a pressure differential across the tool and thereby applying a net force against the plug side of tool 600. A pressure differential applying net force in the opposing direction may also be formed, such as during flowback or production operations, if a second ball, plug, or debris, trapped downwell of the tool engages the bottom section 650 of the tool. However, the pressure differential created across a tool during flowback or production operations is typically lower than a pressure differential from fracturing operations. Slip 624 may be arranged to engage a casing, liner, or other tubular in order to prevent movement of the tool in response to net force against plug side of the tool, during such treatment operations.

The embodiment of FIG. 7 does not incorporate thimble rings (such as rings 332 and 335 of FIG. 4) or expansion rings (such as upper slip 322 and back up ring 335). Element stack 630 has both an upper element stack ring 637 and a lower element stack ring 638 that are widened relative to the element stack rings 337, 338 of FIG. 4. The lower element stack ring 638 may be of 95 durometer rubber or other rubber of suitable mechanical characteristics. Further, cone 640 may have a cone lock, such as shear pin 644, to prevent movement of the cone prior to actuation of the setting tool such as is described in relation to FIG. 5, and connected to the embodiment of FIG. 7 by shear pins 654 in shear pin holes 652. Bypass holes, 657, which may be shear pin holes 652 without shear pins therein, may provide a flow bypass if a ball, plug, or debris engage the throughbore adjacent the bottom section 650 crenels.

Lower section 650 may have an inner surface 655, which may be adjacent to shear pin holes 652, with a diameter slightly smaller (e.g. 0.030 inches) than the inner diameter of the mandrel 610. Such inner surface 655 with smaller diameter will prevent plugs, such as frac balls, located below the flow control device from lodging within the mandrel and blocking flow therethrough—any such plug which can pass inner surface 655 can also pass through the larger throughbore of the diameter. In embodiments containing such an inner surface 655, it will be appreciated the throughbore of the tool will reduced by a corresponding amount.

Generally, the component parts of devices herein are made from ductile iron having a minimum yield strength of 45 k psi. The slips may be made of hardened steel to improve their gripping characteristics. Further, as discussed herein, certain parts, such as the mandrel or cone may be made from materials with higher yield strengths, such as ductile iron with a minimum yield strength of at least 70 k psi. Further, it will be appreciated that some components may be made from composite materials or other materials good machinability, even when the yield strengths of such materials are relatively low compared to commonly used steels.

Embodiment devices may be very short, having lengths less than eight inches and as short as six inches for embodiments holding 4000 psi and as little as 11 or inches, or even less than about 10.5 inches, prior to installation, for embodiments rated to about 8500 psi or 10,000 psi. Embodiment tools may telescope down substantially when set, reducing in length as much as about 2.0 to about 2.25 inches from the run-in position to the set position for embodiments according to FIG. 4 and FIG. 6.

It is desirable that mill out times for embodiment devices be less than 1 hour, equivalent to about 18 inches of device length for embodiments according to the present disclosure. Preferably, mill out times will be less than 45 minutes, or about 15 inches in length. Even more preferably, mill out times will be less than about 30 minutes, or about 12 inches or less in length. It will be appreciated that mill out times will vary depending on the specific milling conditions used—e.g. type of mill, conveyance on jointed pipe or coil tubing, location of the milled device in the well, and other factors.

Mill out time is not the only consideration in determining device length. Specifically, longer devices may be desirable if higher pressure rating is needed because longer element stacks, longer cones, or longer slips may permit pressure ratings above 10,000 psi in some embodiments. However, the required device length for a particular pressure differential may be kept to a minimum using devices according to the disclosure herein as compared to prior art devices.

Some or all of the components of embodiments devices may be made from materials that are disintegrable (e.g. materials that dissolve, disaggregate, melt, or otherwise) when exposed to wellbore fluids, high temperature or other factors over time. Such materials are known and commonly used as plugs such as is described above. Embodiment devices made from such disintegrable materials would have advantages of a ductile iron embodiment such as immediate flowback and production from the formation once treatments are completed. Such embodiments would have at least the additional benefit of the plug being completely removed from the well over time, leaving the casing at full inner diameter for future operations.

The use of the shear screws, or other releasable element for connecting the WLAK in the bottom section (e.g. to items 150, 250, 350, 550 and 650) may help facilitate flexibility in materials selected for producing some embodiments according the present disclosure. Specifically, setting of the tool will involve principally and, in some embodiments, substantially only compressive forces as the mandrel and bottom sub are forced together to set the slips and the element. Some embodiments according to the present disclosure will experience compressive forces which exceed tension forces by a significant margin, allowing use of materials which withstand compression loads much better than tension loads. Thus, materials with lower tensile strengths, including composite or other materials, may be useful for manufacture of the mandrel or other components.

It will be appreciated that enlarged section (e.g. 115 in FIG. 1, 615 in FIG. 7) provides both the plug seat along upper face 312 and functions as a setting ring. In other words, the setting ring comprises the plug seat in some embodiments. The plug seat must have a minimum thickness in order to effectively seal with a plug and it may be necessary that the plug seat have sufficient strength, material strength coupled with thickness, to withstand the forces of a plug landing thereon at relatively high speeds. Further, the plug seat must withstand the force exerted on the plug by the fracturing fluids, force exceeding 100,000 lbs, for a four inch ball at 10,000 psi differential pressure. Embodiments in which the setting ring comprises the plug seat permit a thinner wall because the necessary thickness of the plug seat is at least partially combined in, rather than added to, the necessary thickness of the setting ring. In such embodiments, the mandrel thickness incorporated for desired burst and collapse force integrity is not required to carry all, or even any in some embodiments, of the thickness of the plug seat. Thus, the plug seat dimensions may partially only partially overlap with the mandrel wall dimensions or even be distinct from the mandrel wall dimensions (e.g. the plug seat dimensions are at least partially outside the mandrel wall outer diameter. Other arrangements in which the plug seat width does not overlap, or only partially overlaps, the mandrel wall dimensions are within the scope of the present disclosure.

Further, certain embodiment tool of the present disclosure provide that the setting ring and plug seat are of one piece with the mandrel. Such configuration allows, as discussed above, the thickness of the setting ring to provide thickness for the plug seat. Further, there is no fluid communication into a region between an inner surface of the setting ring and the plug seat (e.g. via a threaded connection between setting ring and the plug seat end of a mandrel). Prior art devices may have threaded setting rings which allow fluid communication between the inner surface of the setting ring and the outer surface of the mandrel, and thereby to the plug seat. Such arrangement both elongates the exposed section and precludes sealing of the plug against the setting ring. In such an arrangement, fluid may pass between and "behind" the ball. Preventing such leak paths may be accomplished by using seals, such as o-rings between a mandrel and a separate, connected setting ring or setting ring/plug seat combination. Any such integrations or unitizations of the setting ring and plug seat, or setting ring with the mandrel is within the scope of the embodiments herein.

Devices according to the present disclosure are described with reference to specific embodiments. Alternatives to the described arrangements will be apparent from a review of the embodiments of the disclosure and such alternatives are within the scope of the invention as claimed. Further, while the embodiments may be described as being made of ductile iron or ductile iron having a particular yield strength, the invention as claimed is not limited to embodiments so constructed.

We claim:

1. A downhole tool having a run-in state and a set state, the downhole tool comprising:

A mandrel having an interior surface defining a passage therethrough and an exterior surface;

a plug seat;

a first setting ring;

at least one slip and a second setting ring positioned below the first setting ring and around the mandrel; and an element between the first setting ring and the second setting ring;

wherein the plug seat and the first setting ring are unitized; and engagement of a plug on the plug seat prevents fluid communication through the passage; and the downhole tool is shorter in the set state than in the run-in state.

2. The downhole tool of claim 1 wherein a single piece comprises the plug seat and the setting ring.

3. The downhole tool of claim 2 wherein the single piece further comprises at least part of the mandrel.

4. The downhole tool of claim 1 further comprising a bottom section at least partially overlapping the mandrel.

5. The downhole tool of claim 4 further a comprising an angular surface, the angular surface slidingly engaging the mandrel between the element and the bottom section, wherein the angular surface engages the slip such that movement of the first setting ring and second setting ring toward one another forces the slip radially outward along the angular surface.

6. The downhole tool of claim 1 comprising a connection between the plug seat and the setting ring that is at least partially in fluid isolation from the exterior of the tool.

7. The downhole tool of claim 1 comprising a connection between the plug seat and the setting ring that is substantially in fluid isolation from the exterior of the tool.

8. The downhole tool of claim 1 wherein the second setting ring telescopes over the mandrel.

9. A downhole tool having a run-in state and a set state comprising:

a mandrel;

a first setting ring, and an element around the mandrel, the element positioned between the setting ring and the plug seat in the run-in state;

a slip; and a bottom section;

wherein the mandrel comprises a plug seat unitized with a second setting ring; and when the downhole tool moves from the run-in state to the set state, the bottom section telescopes over the mandrel, moving the first setting ring and the element toward the plug seat and thereby causing the element to radially expand.

10. The downhole tool of claim 9 wherein the slip surrounds the mandrel.

11. The downhole tool of claim 9 further comprising a cone, wherein movement of the bottom section to the set position forces the slip radially outward over an angular face of the cone.

12. The downhole tool of claim 9 wherein the first setting ring comprises a shoulder for applying force to radially expand the element.

13. The downhole tool of claim 9 wherein the element is between the plug seat and the setting ring in the set state.

14. The downhole tool of claim 9 comprising at least one angular surface not integral with the mandrel, wherein movement of the at least one angular surface relative to the slips causes the slips to expand radially outwardly.

15. The downhole tool of claim 9 wherein the element comprises at least one elastomeric ring, the downhole tool further comprising an anti-extrusion element limiting extrusion of the elastomeric ring into an annular space surrounding the first setting ring.

16. The downhole tool of claim 9:

further comprising a cone slidingly engaging the mandrel; and the bottom section comprises a locking section;

wherein, when downhole tool moves from the run-in state to the set state, the slips expand radially outward along an angular surface of the cone and locking section connects to the mandrel to maintain the downhole tool in the set state.

17. A method for installing a flow control device into a well, the method comprising:

connecting the flow control device to a wireline string, the flow control device comprising a mandrel;

a plug seat unitized to an upper setting ring;

a slip;

a lower setting ring; and an element surrounding the mandrel between the plug seat and the lower setting ring;

the wireline string comprising a check valve that, during the conveying step, facilitates fluid flow through the downhole tool when fluid pressure is greater on the lower setting ring side of the tool than on the upper setting ring side of the tool and reduces fluid flow through the downhole tool when fluid pressure is greater on the upper setting ring side thereof;

placing the flow control device into a well;

conveying the flow control device to a desired location in the well;

moving the upper setting ring and the lower setting ring toward one another, thereby compressing the element;

expanding the slip radially outward to engage a casing in the well;

releasing the flow control device from the wireline string; and removing the wireline string comprising said check valve from the well.

18. The method of claim 17 wherein the flow control device is configured to prevent formation of a pressure differential across the mandrel wall when a plug is engaged on the plug seat.

19. The method of claim 17, the flow control device further comprising a bottom section and the moving step comprises telescoping the bottom section over the mandrel.

20. The method of claim 17 wherein the moving step comprises applying force to the upper setting ring through the plug seat.

21. The method of claim 17, the mandrel comprising a mandrel wall wherein the plug seat has a radial width comprising an outer diameter larger than the outer diameter of the mandrel wall.

22. The method of claim 21 wherein the radial width of the plug seat is at least partially larger than the outer diameter of the mandrel wall.

23. The downhole tool of claim 17 wherein, in the set position, the plug seat comprises a diameter larger than the smallest outer diameter of the mandrel between the plug seat and the element.

24. The method of claim 17 wherein the mandrel comprises an inner surface defining a passage therethrough and the check valve is positioned in the passage.

* * * * *